US005249543A

United States Patent [19]

Rutgerson et al.

[11] Patent Number: 5,249,543

[45] Date of Patent: Oct. 5, 1993

[54] SNATCH BLOCK

[75] Inventors: Goran Rutgerson, Ekebacken, Sweden; Peter O. Harken, Pewaukee; Kenneth E. Lange, Brookfield, both of Wis.

[73] Assignee: Harken, Inc., Pewaukee, Wis.

[21] Appl. No.: 933,343

[22] Filed: Aug. 20, 1992

[51] Int. Cl.[5] ..... B63H 9/04

[52] U.S. Cl. ..... 114/108; 254/405

[58] Field of Search ..... 114/102, 108, 109, 204; 254/402, 403, 405

[56] References Cited

U.S. PATENT DOCUMENTS 3,372,908 3/1968 McCarthy ..... 254/405

4,325,537 4/1982 Winter et al. ..... 254/405

OTHER PUBLICATIONS

Catalog Page from Lewmar Catalog, 1990.

Catalog Page from Holt-Allen Catalog, published in 1985.

*Primary Examiner*—Jesûs D. Sotelo

*Attorney, Agent, or Firm*—Juettner Pyle & Lloyd

[57] ABSTRACT

A snatch block which may be opened to receive a line has a sheave assembly and a pair of sideplates on the sides of the sheave assembly, as well as a head connecting the sideplates. One of the sideplates and sheave is hinged from the head and can pivot toward and away from the other sideplate. A spring loaded plunger is carried by the sheave and engages an aperture in the other sideplate to lock the assembly. The plunger is pushed by a lever in the other direction to open the block.

3 Claims, 2 Drawing Sheets

SNATCH BLOCK

BACKGROUND OF THE INVENTION

As defined, a snatch block is a rotatable sheave or pulley having supporting sideplates. At least one of the sideplates may be moved outwardly to expose the sheave and the line carried thereon. Thus, the block can be opened quickly to receive a line without the necessity of feeding the bitter end of the line into the block and pulling it through.

Especially in sailing vessels, snatch blocks are often employed because of their portability and versatility. The block usually carries a shapshackle, which allows the block to be quickly and easily moved from one support location to another, such as a padeye, toe rail, or traveler track fitting.

Snatch blocks used on sailing vessels have all employed a similar design. The sideplates extend away from the block to a head and a fitting such as a snap shackle. A tongue extends sideways from the head and is engaged by a hasp which is hinged to one of the sideplates. One problem with this design is the difficulty of opening the hasp, especially if there are even moderate loads on the block. Another potential problem is the failure to return the hasp to a fully closed position, causing a failure when the block is loaded.

SUMMARY OF THE INVENTION

The present invention provides a snatch block which is very easily and positively operated between an open and closed position. The sheave and one of the associated sideplates are hinged from the head of the block. The sheave and associated sideplate carry a spring loaded plunger engageable through an opening in the other sideplate. The other sideplate carries a hinged lever engageable with the end of the plunger. The lever is depressed against the force of the spring to disengage the plunger sufficiently to allow the block to open. The block is closed simply by pressing the two sideplates together, allowing the plunger to snap back into a locked position.

Other features and advantages will become apparent from the following description.

THE DRAWINGS

DESCRIPTION OF THE PREFERRED EMBODIMENTS

Figure 2:
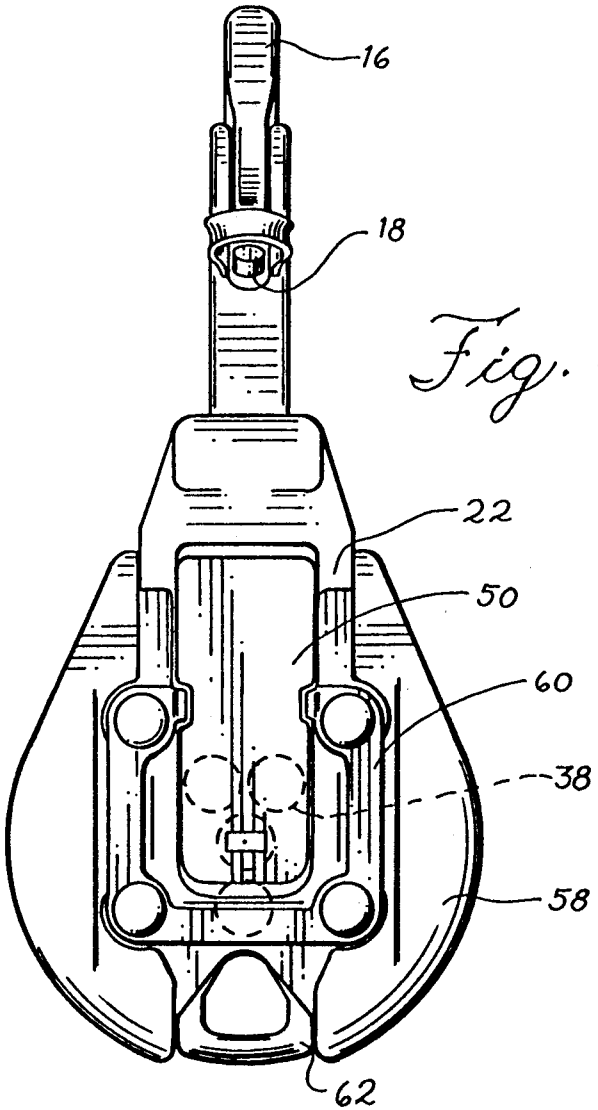
FIG. 2 is a side view of one side of the snatch block in FIG. 1.
Figure 1:
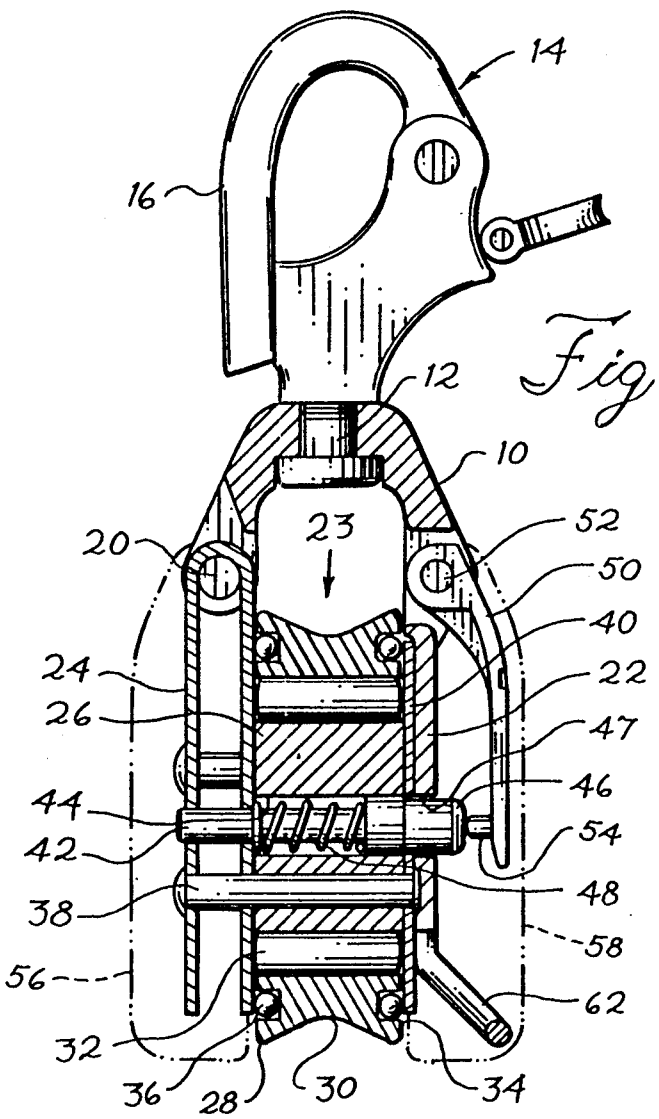
FIG. 1 is a partial vertical sectional view through the snatch block of the present invention.

FIGS. 1 and 2 show a snatch block having a head 10 for attachment to a rotary post 12 of a conventional snap shackle 14 or other attachment fitting. The snap shackle 14 has a hinged J-shaped member 16 releasably closed by a spring loaded pin 18 and is well known in the art.

The head has a pair of depending legs between which are received the rotary sheave of the block. One of the legs is shorter and terminates at a hinge pin 20. The other leg is elongated and forms one of the structural sideplates 22 of the block. A second structural sideplate

24, in the form of an inverted U-shaped member is hinged around the hinge pin 20.

A rotatable sheave assembly 23 is secured to the hinged sideplate 24 from the inner race 26 of the sheave assembly.. The sheave assembly comprises a fixed cylindrical inner race 26, an outer annular race 28 having a line receiving groove 30, and bearings, such as the plurality of roller bearings 32 as shown, between the inner and outer races. The sides of outer race 28 may contain annular grooves 34 concentric with the axis of rotation of the outer sheave, and races of ball bearings 36 are provided in said grooves to minimize friction with the sideplates.

The sheave assembly is secured to and against the inner leg of sideplate by means of rivets 38 or other suitable fasteners. The sheave assembly is self contained by virtue of a secondary and relatively thin retaining plate 40 secured against the other side of the sheave by the rivets 38 which pass through openings in the inner race. Thus the sideplate 24 and sheave assembly 23 can pivot around the hinge pin 20 relative to the other portions of the block. The axis of the hinge pin 20 is transverse to the rotary axis of the sheave assembly.

The locking or opening and closing mechanism comprise a plunger pin 42 slidably received in an axial opening 44 through the center race 26 and sideplates 22 and 24. The plunger pin may comprise an enlarged head 46 extendable through a corresponding opening 47 in the fixed sideplate 22. The plunger pin 42 is spring loaded to a fixed extent outwardly toward sideplate 22 by means of helical spring 48 between the enlarged head 46 and the sideplate 24 within the inner race.

Means are provided for depressing the plunger pin 42 against the force of the spring 48 to a sufficient extent to cause disengagement between the pin head 46 and the opening 47 in the fixed sideplate 22. A lever 50 is hinged at one end to a hinge pin 52 in the fixed sideplate 22 located near the head 10. The other end of the lever 50 overlies the exposed end 46 of the plunger pin and may contain a cylindrical or pin-like protrusion 54 engageable with the exposed end of the pin.

The outer portions sideplates 24 and 22 are each preferably encased in a resilient or shock absorbing material, shown at 56 and 58. The material used in these outer casings may comprise any suitable, non-marring and weather resistant polymer such as polyurethane or a suitable elastomer. As shown in the Figures, the lever 50 is preferably recessed inwardly from the outer side surface of the block, in order to minimize accidental disengagement. As shown in FIG. 2, a separate stop plate 60 providing a wall around the perimeter of the lever may be additionally employed for this purpose. Also, as shown, the lever 50 may be rectangular in form, and a corresponding rectangular opening may be provided in the sideplate 22 for a more compact structure.

A bail 62 may be provided at the end of the fixed sideplate. A major purpose of the bail 62, in the form of a closed loop, is to allow the block to be supported in a desired upright position from the shackle 14 by means of a line secured between the bail and a secondary support.

The snatch block is shown in a closed position in FIG. 1, in which the pin end from the hinged portion of the assembly extends through the opening 47 under spring pressure, allowing the block to carry normal loads.

Figure 4:
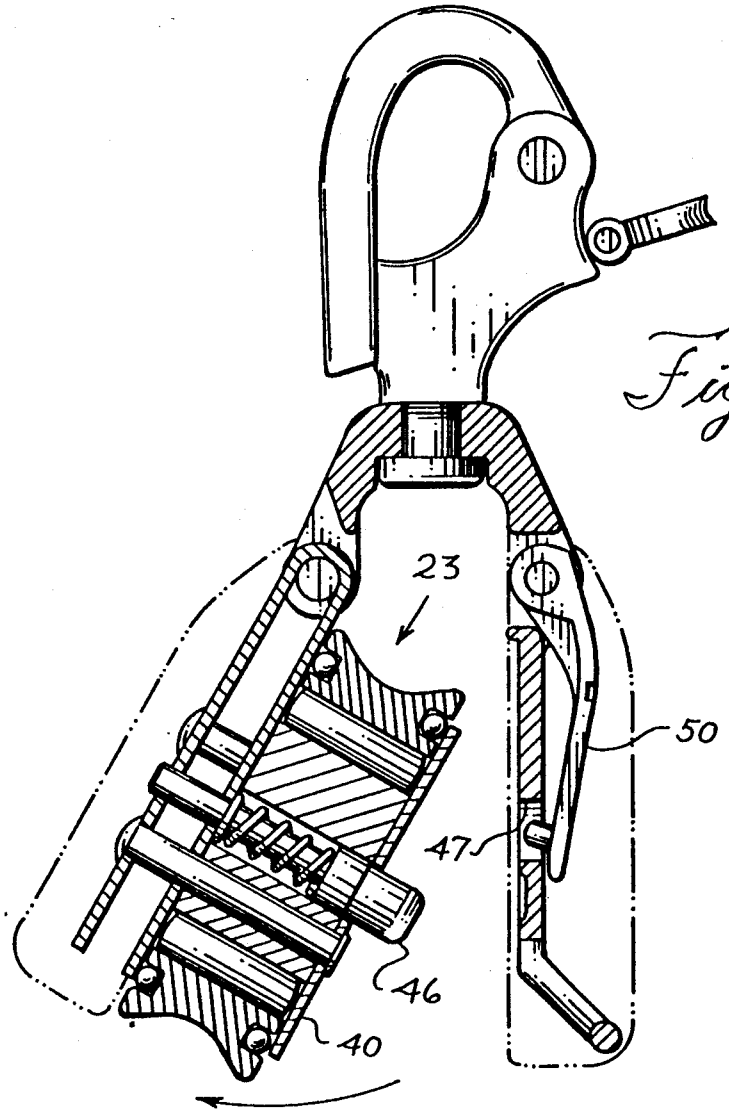
FIG. 4 is a view similar to FIGS. 1 and 3 showing the block in an open position.
Figure 3:
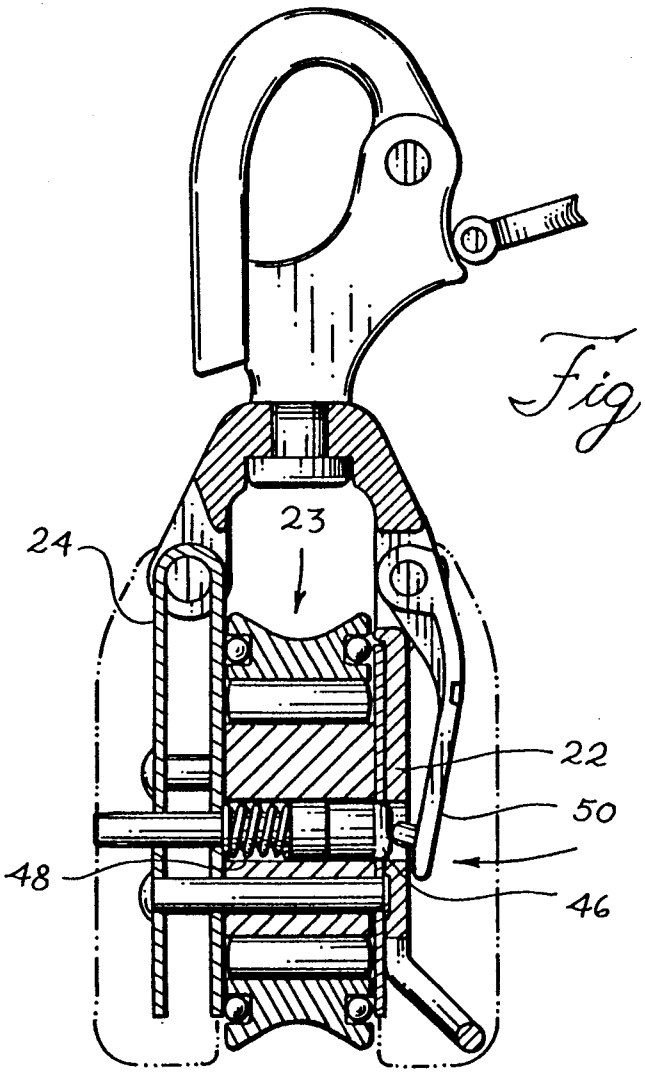
FIG. 3 is a view similar to FIG. 1 showing depression of the lever to open the block.

In order to open the block, as shown in FIG. 3, the lever 50 is depressed near its free end in the direction indicated by the arrow to push the pin 46-42 out of engagement with the fixed sideplate opening 47, whereupon the hinged sideplate and sheave assembly 23-24 may pivot or tilt away from the relatively fixed sideplate 22, or in a direction indicated by the arrow in FIG. 4. Upon opening, a line (not shown) may be inserted through the opening and placed over the sheave.

The block is then closed by pushing the sideplates together with sufficient force to overcome the pressure of the spring 48, whereupon the pin head 46 reengages in the opening 42 and locks the block in a closed position.

It may be seen that the snatch block of the present invention provides a convenient and reliable lock and release feature, with the locking feature being spring assisted, causing the pin to snap into position when the block is closed, and providing an audible indication of locking.

In addition to the features noted above, in comparison with the hasp-type snatch blocks, the block of the present invention can be opened with one hand. This is an important advantage, for example, while sailing in rough seas, when the other hand is needed for support.

Another important feature relates to safety considerations. As the block is depressed by pushing the lever with the thumb, the line carrying sheave swings away from the hand to avoid possible injury, especially if the line is loaded.

We claim:

1. An improved snatch block comprising a sheave assembly having an inner race and a rotatable outer race, first and second sideplates extending along the sides of the sheave assembly, and a head extending between the sideplates to enable attachment of the block to the support, wherein the improvement comprises means for securing the inner race of the sheave assembly to the first sideplate, means for hingedly connecting the first sideplate near the head to allow pivotal movement thereof toward and away from the second sideplate, lock means carried by the inner race for releasable locking with the second sideplate, said lock means comprising an aperture in the second sideplate, and a plunger slidably mounted in said inner race and engageable with said aperture, said plunger being spring loaded toward said second sideplate, and a manually operated member on the second side plate for pushing said plunger toward the first sideplate for releasing the lock means.

2. The improvement of claim 1 wherein said manually operated member comprises a lever hinged at one end to the second sideplate near the head, the other end being engageable with the plunger.

3. The improvement of claim 1 wherein said lock means comprises aligned apertures through said first and second sideplates and said inner race, with said plunger being slidable in said apertures.

* * * * *